United States Patent [19]

Wilkerson

[11] Patent Number: 4,538,428

[45] Date of Patent: Sep. 3, 1985

[54] ICE-MAKING MACHINE

[76] Inventor: Kenneth L. Wilkerson, Rte. 3, Box 6, De Funiak Springs, Fla. 32433

[21] Appl. No.: 595,963

[22] Filed: Apr. 2, 1984

[51] Int. Cl.[3] ..... F25C 1/14

[52] U.S. Cl. ..... 62/354; 165/94; 366/312

[58] Field of Search ..... 62/354; 165/94; 366/309, 312, 313

[56] References Cited

U.S. PATENT DOCUMENTS

| | | | |
|---|---|---|---|
| 853,740 | 5/1907 | Schober | 366/313 X |
| 2,009,734 | 7/1935 | Hiller et al. | 366/309 X |
| 2,282,298 | 5/1942 | Vogel | 366/312 |
| 2,930,058 | 3/1960 | Ratje | 62/354 X |
| 3,069,866 | 12/1962 | Dunn | 62/354 X |
| 3,534,563 | 10/1970 | Ross | 62/354 X |
| 3,835,922 | 9/1974 | Raths | 62/354 X |
| 3,921,415 | 11/1975 | Kattis | 62/354 |

FOREIGN PATENT DOCUMENTS

| | | | |
|---|---|---|---|
| 169116 | 4/1903 | Fed. Rep. of Germany | 366/312 |
| 2111450 | 10/1971 | Fed. Rep. of Germany | 62/354 |
| 1385898 | 3/1964 | France | 62/354 |
| 628513 | 11/1961 | Italy | 62/354 |

*Primary Examiner*—William E. Tapolcai

*Attorney, Agent, or Firm*—Harvey B. Jacobson

[57] ABSTRACT

An ice-making machine comprises an evaporator structure submerged in suitable ice-forming liquid in a holding tank. The evaporator structure comprises a cylindrical single-tube evaporator disposed vertically on a support frame on the base of the tank and connected to refrigeration plant externally of the tank. A rotary scraper assembly having a scraper blade for scraping ice continuously off the outer cylindrical surface of the evaporator is mounted in the tank, so that the ice floats to the top of the liquid for pumped removal from the tank if required. The scraper assembly is rotated by a motor mounted above the tank. The evaporator and scraper structure form a unit which can be used in different liquid holding tanks.

20 Claims, 4 Drawing Figures

ICE-MAKING MACHINE

BACKGROUND OF THE INVENTION

This invention relates to ice-making equipment and more particularly to a novel form of evaporator structure which can be readily adapted for submersion in a tank of suitable ice-forming liquid, and for connection to suitable refrigeration plant externally of the tank, so as to provide ice formation on outer surfaces of the evaporator, the structure further including a scraper assembly for scraping ice off of the outer evaporator surfaces as the ice is formed, for flotation of the ice to the top of the liquid from where it may be removed for diverse purposes, if and when required.

STATEMENT OF PRIOR ART

The following U.S. patents pertain to ice-making machines and the like, none of which, however, has the features of the present invention.

U.S. Pat. Nos. 2,308,541; 2,344,922; 2,585,020; 2,902,839; 3,159,010; 3,921,415.

SUMMARY OF THE INVENTION

An evaporator structure in accordance with the invention is readily adapted for submersion in any suitable tank of liquid for the formation of ice on the outer surfaces of the evaporator when the evaporator is connected as part of a conventional-type refrigeration circuit. The structure is particularly flexible in its usage both with respect to the type of liquid tank in which it can be used, and the type of refrigeration equipment with which it can be used. Further, crystalline ice scraped from the evaporator surfaces, preferably on a continuous basis, and which floats to the top of the liquid can be used in numerous applications, and can either be floated or pumped from the top of the holding tank.

At least in a preferred form of the invention, the evaporator may comprise a closed cylindrical cell (which may constitute a single-tube evaporator) for example of stainless steel having an inlet and outlet for refrigerant supplied to the evaporator, for example, from an expansion valve and delivered from the evaporator to a compressor of a standard refrigeration circuit not forming a part of the invention, the evaporator further being provided with a stand, frame or the like for supporting same in an upright submerged position (i.e. with its axis vertically oriented) in the liquid holding tank.

Further in accordance with the invention, the structure may include a scraper assembly for scraping ice from the cylindrical outer surface of the evaporator comprising a rotary cage-like structure surrounding the evaporator cell, including at least one upright scraper blade mounted between end plates disposed coaxially above and below the evaporator cell for rotation by suitable drive means about the common axis thereof with the blade substantially contacting the outer cylindrical surface of the cell so as to continuously scrape away the ice as it is formed by rotation of the scraper assembly. Additionally, the scraper blade may be provided with spring-biasing means urging same toward the cylindrical surface of the cell. There may be two or more such scraper blades on the scraper assembly, and the assembly may be driven through a suitably supported shaft from a motor mounted above the liquid holding tank. The or each scraper blade may be inclined with respect to the cylindrical surface of the evaporator cell in the direction of rotation of the blade, in order to facilitate ice removal from the cell.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 2:
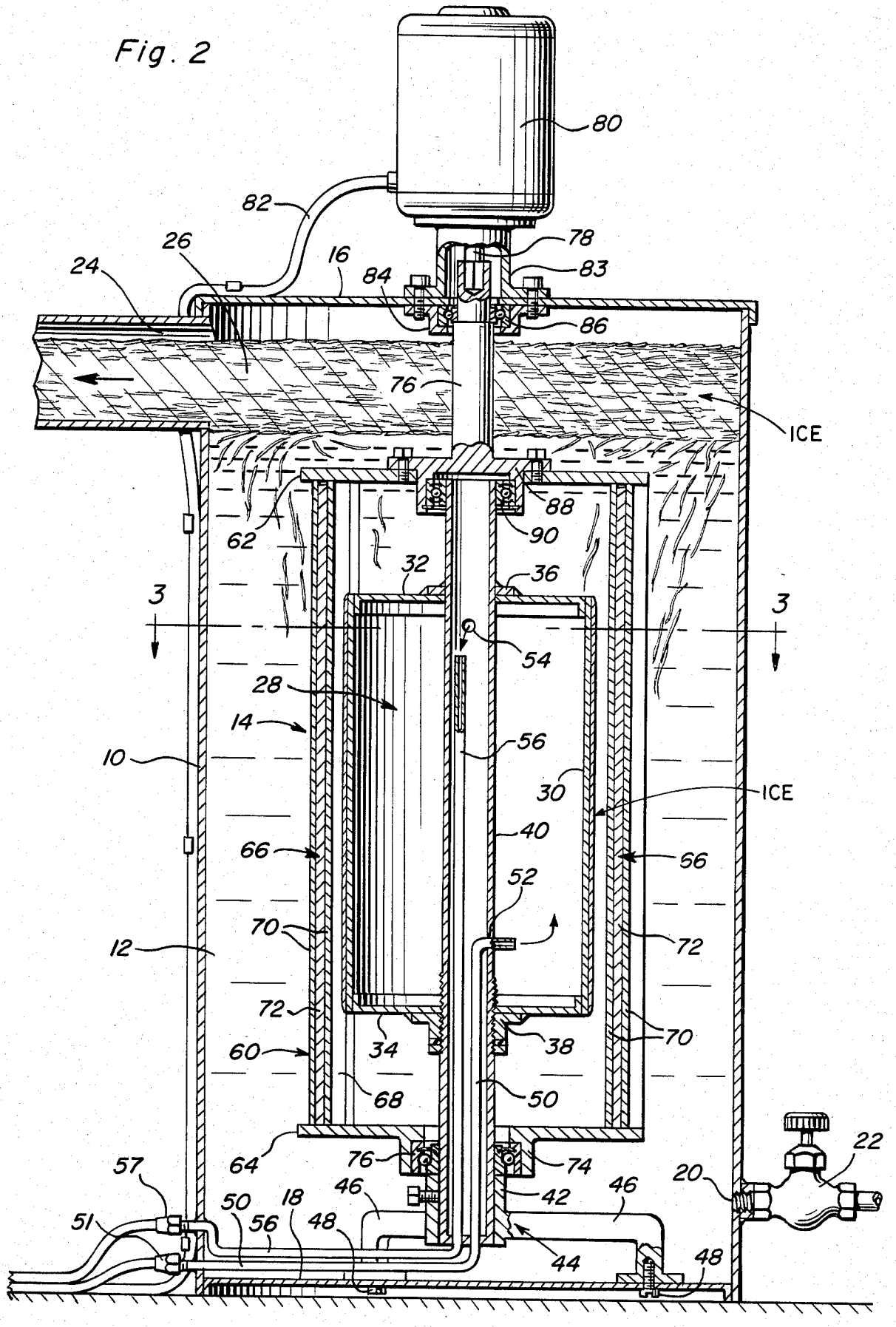
FIG. 2 is an enlarged sectional view on line 2—2 of FIG. 1.

The illustrated ice-making equipment comprises a holding tank 10 (which may be insulated) for a binary ice-forming solution 12 or the like, and an evaporator structure 14 submerged in the liquid 12 within the tank (see particularly FIG. 2). Tank 10 may have a cover 16, a base 18, an inlet 20 for the liquid 12 near the base, and controlled by a valve 22, and an outlet 24 adjacent the top of the tank for the pumped or flotation discharge of ice 26 made by the evaporator structure as will be described.

Evaporator structure 14 comprises an enclosed evaporator cell 28 having a stainless steel cylindrical outer wall 30 and end caps 32, 34 which support the shell by means of welded or threaded flanges 36, 38 on a vertical support tube 40. Tube 40 is itself secured, such as in a collar 42 on a three-legged base 44, the legs 46 of which may be secured to base 18 of tank 10 by screws 48 or the like. An inlet pipe 50 for introducing refrigerant, for example from an expansion valve, not shown, of a conventional refrigeration plant, into cell 28, extends upwardly through tube 40 and into the interior of shell 28 through an opening 52 in the tube. An upper opening 54 is provided in tube 40 for delivering heated refrigerant to an outlet pipe 56 extending downwardly through tube 40 from where it may deliver the refrigerant, for example, to a compressor (not shown) of the refrigeration plant. Pipes 50 and 56 may have respective connections 51 and 57 for connecting them to the refrigeration plant externally of tank 10.

Cell 28 accordingly forms a single-tube evaporator for the refrigeration plant serving to withdraw heat from solution 12 with the formation of sheet ice 58 on the outer surfaces of the shell. In accordance with the invention, the evaporator structure includes a cage-like rotary scraper assembly 60, described below, surrounding cell 28 for continuously scraping the ice 58 from cylindrical wall 30 as it is formed.

Figure 1:
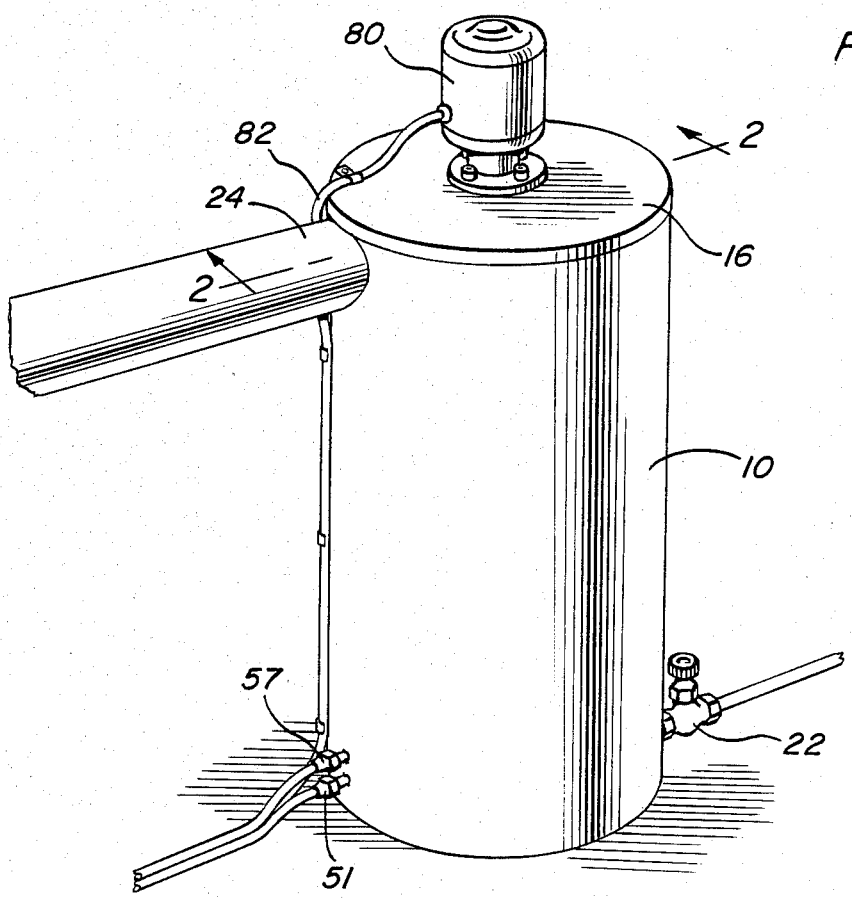
FIG. 1 is a perspective view of ice-making equipment comprising a liquid holding tank provided with an internal evaporator structure in accordance with the invention.
Figure 3:
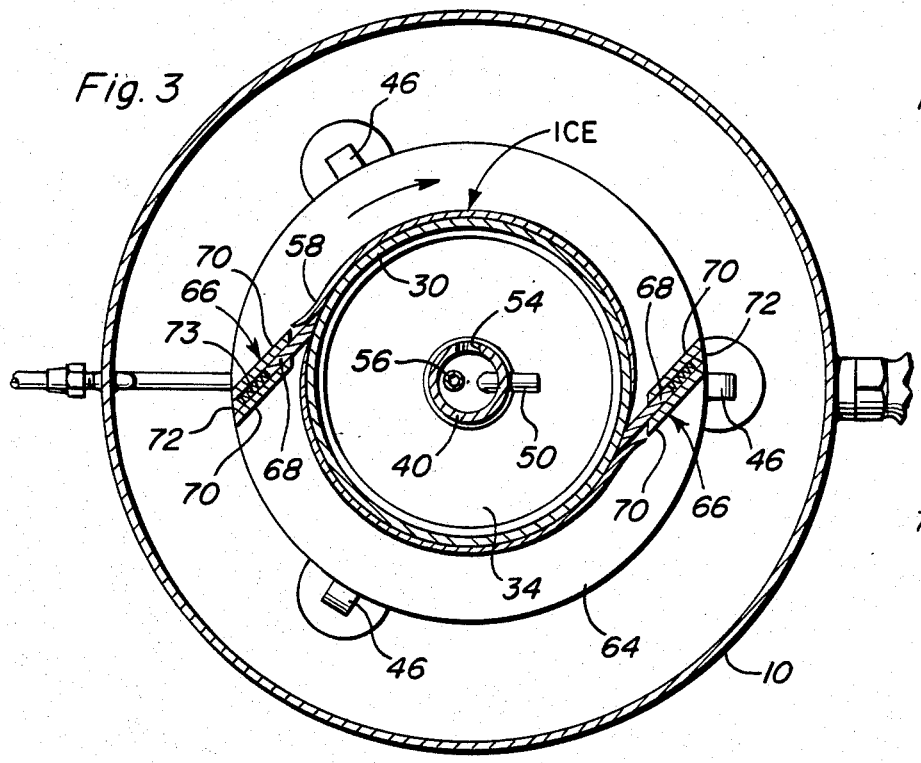
FIG. 3 is a sectional view on line 3—3 of FIG. 2.
Figure 4:
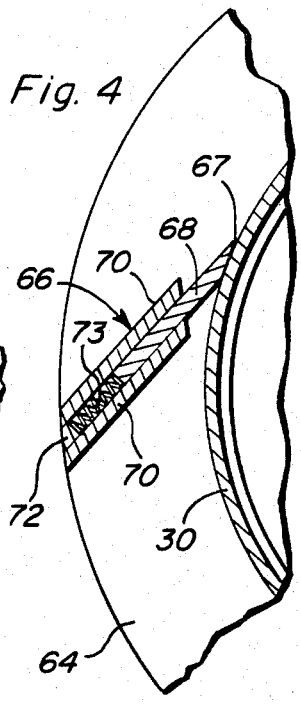
FIG. 4 is an enlarged view of a part of FIG. 3 showing a scraper blade construction.

Scraper assembly 60 comprises upper and lower end plates 62, 64 connected by diametrically opposed vertical blade guides 66 housing plastic scraper blades 68 for scraping the ice from wall 30. Each blade guide has a pair of closely spaced side walls 70 between which the respective blades are received and an end wall 72. Further, each blade guide is provided with a series of springs 73 acting between the end wall 72 and the back of the respective scraper blade, so as to urge the sharpened forward end 67 of the blade toward engagement with wall 30. To facilitate ice removal, instead of being diametrically disposed, the scraper blades are inclined in the direction of rotation of the assembly, for example at about 45° angle, as shown in FIGS. 3 and 4. While the illustrated embodiment employs a pair of diametrially opposed scraper blades, the number of blades can be varied to suit the particular application.

Lower end plate 64 of the scraper assembly may, for example, be provided with a flange 74 receiving a thrust bearing 76 or the like supporting the rotary assembly on collar 42 (FIG. 2) and the upper end plate 62 may be secured to a flanged shaft 76 connected to the output shaft 78 of a suitably geared electric motor 80 having a supply cable 82. The motor may be mounted on tank cover 16, so as to provide rotation of the scraper assembly at suitable RPM, e.g. about 6 RPM. The motor may be secured on cover 16 by a flanged connection 83, and a cover 84 may receive an upper shaft bearing 86. A flanged connection 88 between end plate 62 and shaft 76 may include a lower bearing 90 which journals the scraper assembly on the upper end of tube 40. Clearly, alternative mounting and drive arrangements can be provided for the rotary scraper assembly.

It will be appreciated from the foregoing that in use, ice is continuously formed on and scraped from wall 30 of the evaporator cell, so that the scraped ice floats to the top of tank 10 where it may be stored, or discharged by pumping or flotation for use as ice in general, or for thermal storage air conditioning. The level of solution in tank 10 may be suitably controlled by valve 22. When the equipment is used for thermal storage, it can also be used to make hot water for heat by reversing the refrigerant cycle, with the evaporator becoming a de-superheater to heat the solution. Since the equipment may be submerged in solution in an insulated tank, there is little heat lost and excellent heat transfer.

The equipment in accordance with the invention is of simplified construction, having a minimum of valves, no timers, and no conveyor systems. The device employs a single motor and the scraper assembly is the only moving part within the tank. Ice can be made continuously with no defrost cycle, and the device uses about 40% less energy than conventional ice-making machines, since it will produce ice at 28° F., while most conventional machines use 0° F. to 10° F. and may employ up to four motors. Since the device is remote from the remainder of the refrigeration plant, it can be used with diverse forms of compressor and almost any type of refrigerant. Since the ice produced is in slush form it can be pumped rather than conveyed. Further, the machine is simple to maintain and compact in size, a one ton per 24 hour machine, for example, being only five inches in diameter and twelve inches long.

The machine makes crystal rather than flake ice, crystal ice requiring less energy to make, but having the same thermal capacity as regular ice. The spring-loaded scraper blades riding directly against the evaporator, scrape away substantially all of the ice as it is formed, promoting efficient heat transfer. The blades are self-adjusting, and self-sharpening, thereby reducing maintenance. While not shown in the drawings, the evaporator end caps can also be provided with scraper blades, particularly on large machines, thereby further increasing efficiency. The device can make ice from any water-based liquid, such as sodium chloride, calcium chloride, glycol solution, or sea water. Further, by changing the plastic (e.g. Teflon) scraper blades to steel blades, fresh water ice can be produced. The evaporator structure of the invention which may be free standing on the base of tank 10, is portable and can therefore be used to manufacture ice interchangeably in any suitable liquid holding tank, a facility not previously available in ice-making machines. In this respect, it is understood that the evaporator and scraper structure form a unit which may be used in any suitable holding tank and with any suitable refrigeration equipment.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An evaporator structure for submersion in liquid in a holding tank for making ice from the liquid, the structure comprising an enclosed evaporator cell having a cylindrical outer wall, inlet and outlet means for the delivery of refrigerant into and out of the evaporator cell, respectively, means for connecting the inlet and outlet to refrigeration plant externally of the tank so as to provide a refrigeration circuit effective to form ice on said cylindrical wall when the structure is immersed in ice-forming liquid in the tank, a rotary scraper assembly associated with the evaporator cell including at least one elongate scraper blade for scraping ice from said cylindrical wall responsive to rotation of the scraper assembly, support means for supporting the evaporator cell and scraper assembly in the tank, and drive means for rotating the scraper assembly, wherein the support means comprises means for supporting the evaporator cell with its longitudinal axis vertically disposed in the holding tank, and wherein the scraper assembly comprises a cage-like assembly surrounding the evaporator cell with upper and lower end plates above and below the cell, respectively, and guide means for said scraper blade connected between the end plates, the guide means comprising sidewalls embracing the blade, an end wall, and spring means positioned between the end wall and an outer edge of the blade for urging an inner edge of the blade toward engagement with said cylindrical wall.

2. The invention of claim 1 wherein the support means comprises a support frame for standing the evaporator cell on a base member of the tank.

3. The invention of claim 2 wherein the frame has an upwardly extending tube on which the cell is mounted.

4. The invention of claim 3 wherein the scraper assembly is journally supported around the tube.

5. The invention of claim 4 wherein the drive means comprises a drive shaft, connected to the upper end plate of the scraper assembly coaxially with the tube, for connection to a drive motor mounted above the tank.

6. The invention of claim 3 wherein the evaporator cell defines a single-tube evaporator.

7. The invention of claim 6 wherein the evaporator inlet and outlet comprise respective openings in the upwardly extending tube, and the connecting means comprises pipes extending upwardly through the tube and communicating with the respective openings.

8. The invention of claim 1 wherein the scraper blade is made of plastic.

9. The invention of claim 1 wherein the scraper blade is inclined with respect to the cylindrical surface of the evaporator cell in the direction of rotation of the scraper assembly.

10. The invention of claim 9 wherein the scraper blade and guide means is located on one side of the scraper assembly and are replicated on the opposite side of the scraper assembly.

11. An ice-making machine comprising a liquid holding tank, an enclosed evaporator cell of a refrigeration circuit immersed in liquid in the tank, the cell having a vertical cylindrical wall for the formation of ice thereon, and an rotary scraper assembly supported in the tank for rotation about an axis substantially corresponding with the axis of said cylindrical wall, the scraper assembly including at least one elongate scraper blade for continuously scraping ice off of the outer surface of said cylindrical wall as it is formed responsive to rotation of the scraper assembly for flotation of the ice to the top of the liquid, wherein the evaporator cell is carried on an axial support tube which incorporates inlet and outlet refrigerant pipes for connecting the cell to refrigeration plant externally of the tank, the inlet pipe opening into the cell through a first hole in the tube, the tube having a second hole for discharging refrigerant from the cell into the outlet pipe, and the scraper assembly being journally supported on the tube externally of the evaporator cell.

12. The invention of claim 11 including a support frame supporting the tube on a base member of the tank with its axis extending vertically therefrom, the scraper assembly comprising a cage-like assembly having upper and lower end plates respectively journally supported on the tube above and below the evaporator cell and guide means for said at least one blade extending between the end plates.

13. The invention of claim 12 including a drive shaft for the scraper assembly extending upwardly from the upper end plate coaxially with the evaporator cell for connection to a drive motor above the tank.

14. The invention of claim 13 wherein the tank includes a cover and means for mounting the drive motor thereon.

15. The invention of claim 11 wherein the tank has a valve-controlled liquid inlet and an ice outlet adjacent its upper end for the removal of ice from the tank by pumping or flotation.

16. The invention of claim 12 wherein the guide means includes sidewalls embracing the blade, an end wall, and spring biasing means between the end wall and an outer edge of the blade for urging an inner edge of the blade toward scraping engagement with the cylindrical wall.

17. The invention of claim 16 wherein the blade is inclined with respect to said wall in the direction of rotation of the scraper assembly.

18. The invention of claim 16 wherein the scraper means and guide means is located on one side of the scraper assembly and are replicated on the opposite side of the scraper assembly.

19. The invention of claim 11 wherein the evaporator cell defines a single-tube type evaporator having an inlet and outlet for refrigerant, and piping for connecting the inlet and outlet to refrigeration plant externally of the tank.

20. The invention of claim 19 wherein the evaporator cell is disconnectible from the external refrigeration plant, and the evaporator cell and scraper assembly are removable from the tank for use as a unit in another liquid holding tank.

* * * * *